US010096884B2

(12) United States Patent
Shen et al.

(10) Patent No.: US 10,096,884 B2
(45) Date of Patent: Oct. 9, 2018

(54) RESONATOR, FILTER, DUPLEXER, AND MULTIPLEXER

(71) Applicant: Huawei Technologies Co., Ltd., Shenzhen (CN)

(72) Inventors: Zhen Shen, Shanghai (CN); Dan Liang, Kista (SE); Xiaoyi Deng, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 116 days.

(21) Appl. No.: 15/156,137

(22) Filed: May 16, 2016

(65) Prior Publication Data

US 2016/0261018 A1 Sep. 8, 2016

Related U.S. Application Data

(63) Continuation of application No. PCT/CN2013/087304, filed on Nov. 18, 2013.

(51) Int. Cl.

| | |
|---|---|
| ***H01P 7/04*** | (2006.01) |
| ***H01P 1/213*** | (2006.01) |
| ***H01P 1/207*** | (2006.01) |
| ***H01P 5/12*** | (2006.01) |
| ***H01P 7/06*** | (2006.01) |

(52) U.S. Cl.

CPC ..... *H01P 7/04* (2013.01); *H01P 1/207* (2013.01); *H01P 1/2136* (2013.01); *H01P 5/12* (2013.01); *H01P 7/06* (2013.01)

(58) Field of Classification Search

CPC .... H01P 5/12; H01P 1/207; H01P 7/04; H01P 7/06

USPC ..... 333/132

See application file for complete search history.

(56) References Cited

U.S. PATENT DOCUMENTS

| | | | |
|---|---|---|---|
| 4,024,481 | A | 5/1977 | Kivi |
| 4,477,786 | A | 10/1984 | Tamura et al. |
| 4,728,913 | A | 3/1988 | Ishikawa et al. |
| 4,963,841 | A | 10/1990 | Sparagna |

(Continued)

FOREIGN PATENT DOCUMENTS

| | | | |
|---|---|---|---|
| CN | 1277469 | A | 12/2000 |
| CN | 1673174 | A * | 9/2005 |

(Continued)

*Primary Examiner* — Benny Lee
*Assistant Examiner* — Hafizur Rahman
(74) *Attorney, Agent, or Firm* — Slater Matsil, LLP

(57) ABSTRACT

A resonator, a filter, a duplexer, and a multiplexer are disclosed. In an embodiment a resonator includes a resonant cavity casing having a resonant cavity and an open end, a cover covering the open end and being connected to the resonant cavity casing and a resonance tube located inside the resonant cavity. The resonator further includes a tuning rod disposed inside the resonance tube and a dielectric material located in the resonant cavity, wherein the dielectric material is located in a capacitance area formed between a top of the resonance tube and the cover, wherein the tuning rod is rotatable relative to the dielectric material, and wherein surfaces of the tuning rod and the dielectric material face each other and comprise non-circular structures so that an overlapping of the surfaces is changeable to adjust a frequency when the tuning rod is rotated relative to the dielectric material.

20 Claims, 7 Drawing Sheets

(56) References Cited

U.S. PATENT DOCUMENTS

| | | | | |
|---|---|---|---|---|
| 6,222,428 | B1 | 4/2001 | Akesson et al. | |
| 6,255,917 | B1 | 7/2001 | Scott | |
| 6,320,484 | B1 | 11/2001 | Furuya et al. | |
| 6,384,699 | B1 | 5/2002 | Henningsson et al. | |
| 7,180,391 | B2 * | 2/2007 | Ala-Kojola | H01P 1/2053 333/134 |
| 2001/0043132 | A1 | 11/2001 | Saito et al. | |
| 2005/0030130 | A1 | 2/2005 | Alford | |
| 2009/0237185 | A1 | 9/2009 | Raty | |
| 2013/0088306 | A1 * | 4/2013 | Subedi | H01P 1/20 333/134 |

FOREIGN PATENT DOCUMENTS

| | | | |
|---|---|---|---|
| CN | 102903987 | A | 1/2013 |
| CN | 103022621 | A | 4/2013 |
| CN | 103311633 | A | 9/2013 |
| GB | 2452293 | A | 3/2009 |
| WO | 9936982 | A2 | 7/1999 |
| WO | 2004084340 | A1 | 9/2004 |
| WO | 2006138157 | A2 | 12/2006 |

* cited by examiner

RESONATOR, FILTER, DUPLEXER, AND MULTIPLEXER

CROSS-REFERENCE TO RELATED APPLICATIONS

This application is a continuation of International Application No. PCT/CN2013/087304, filed on Nov. 18, 2013, which is hereby incorporated by reference in its entirety.

TECHNICAL FIELD

The present invention relates to the field of communications devices, and in particular, to a resonator, a filter, a duplexer, and a multiplexer.

BACKGROUND

A broadband development trend of wireless communication requires that performance such as a loss can remain basically unchanged when a radio frequency front-end duplexer of a base station has a smaller volume, a larger power capacity, and lower costs. A cavity filter is a traditional technology of the duplexer of the base station, where the technology is mature and costs are low. The cavity filter generally includes a cover and multiple cavity casings, and multiple resonance tubes are disposed in each cavity casing. A function of each cavity casing is equivalent to an electronic oscillation circuit. When the filter is tuned to a proper wavelength of a receive signal, the oscillation circuit may be represented as a parallel oscillation circuit that includes an inductance part and a capacitance part, and a resonance frequency of the filter may be adjusted by adjusting the inductance part or the capacitance part.

A capacitance adjustment method is adjusting spacing between the resonance tube and the cover, and adjustment of the spacing is generally implemented by rotating a tuning screw out of or into a screw hole on the cover. As a volume of a single cavity continuously decreases, surface current density of the single cavity increases and a loss continuously increases; a volume decrease also shortens a distance between conductor surfaces inside the single cavity, a decrease in an electric intensity threshold obtained when an air breakdown occurs is caused, and a power capacity becomes smaller. Therefore, a volume of the cavity filter is smaller, a loss is greater, and a power capacity filter is smaller, which cannot meet the requirement of a smaller volume and unchanged performance.

The cavity filter generally uses a metal resonator, that is, the cavity casing, the resonance tube, and the like are all made of metal materials, or metalized materials at least on inner surfaces of the cavity casing. In a case in which a TM (transverse magnetic) mode dielectric filter has a same volume as the single cavity of the cavity filter, because the TM mode dielectric filter uses a high-performance ceramic resonator to replace the metal resonator, a smaller insertion loss can be implemented when a conductor loss reduced by the high-performance ceramic resonator is greater than a dielectric loss brought by the high-performance ceramic resonator. In addition, because a position in which an electric field of the TM mode dielectric filter is the strongest is inside a dielectric, and breakdown electric intensity of a dielectric material is far higher than that of air, the power capacity can also be greatly improved. However, a high-performance ceramic material generally includes a rare earth, and a price of the rare earth is high because of a global scarcity of a rare earth resource.

SUMMARY

Embodiments of the present invention provide a resonator that can reduce a conductor loss and costs relatively low, and a filter, a duplexer, and a multiplexer that use the resonator.

Embodiments of the present invention further provide a resonator that can reduce a conductor loss and facilitates frequency adjustment, and a filter, a duplexer, and a multiplexer that use the resonator.

According to a first aspect, a resonator is provided, including a resonant cavity casing that has a resonant cavity and an open end, a cover that covers the open end and is connected to the resonant cavity casing, a resonance tube located inside the resonant cavity, and a tuning screw, where the tuning screw is connected to the cover and stretches into space encircled by the resonance tube, the resonator further includes a dielectric material that is filled in the resonant cavity and whose dielectric constant is greater than 1, and the dielectric material is filled in a capacitance area formed between the top of the resonance tube and the cover.

In a first possible implementation manner of the first aspect, an upper end surface and a lower end surface of the dielectric material respectively are in contact with a lower surface of the cover and an upper surface of the resonance tube.

In a second possible implementation manner of the first aspect, the capacitance area includes at least one of an area between the resonance tube and the cover, an area between the tuning screw and an inner wall of the resonance tube, or an area between an outer edge of the resonance tube and a cavity wall of the resonant cavity.

In a third possible implementation manner of the first aspect, a quality factor Qf of the dielectric material is greater than 5000.

In a fourth possible implementation manner of the first aspect, the filled dielectric material is crimped between the cover and the resonance tube.

In a fifth possible implementation manner of the first aspect, the filled dielectric material is separately bonded or welded to the cover and the resonance tube.

In a sixth possible implementation manner of the first aspect, the resonance tube is integrated with the resonant cavity casing as one casing.

In a seventh possible implementation manner of the first aspect, the dielectric material includes: ceramic, monocrystalline quartz, or spherical alumina.

According to a second aspect, a filter is provided, including at least one resonator provided in the foregoing first aspect.

According to a third aspect, a duplexer is provided, including a transmitter channel filter and a receiver channel filter, where the transmitter channel filter and the receiver channel filter perform filtering by using the filter in the foregoing second aspect.

According to a fourth aspect, a multiplexer is provided, including multiple transmitter channel filters and multiple receiver channel filters, where the transmitter channel filters and the receiver channel filters perform filtering by using the filter in the foregoing second aspect.

According to a fifth aspect, a resonator is provided, including: a resonant cavity casing that has a resonant cavity and an open end, a cover that covers the open end and is connected to the resonant cavity casing, a resonance tube located inside the resonant cavity, and a tuning rod disposed inside the resonance tube, where the resonator further includes a dielectric material that is filled in the resonant cavity and whose dielectric constant is greater than 1, the dielectric material is filled in a capacitance area formed between the top of the resonance tube and the cover, the tuning rod is rotatable relative to the dielectric material, and face-to-face surfaces of the tuning rod and the dielectric material are a non-circular structure, so that the tuning rod adjusts a frequency when being rotated relative to the dielectric material.

In a first possible implementation manner of the fifth aspect, an upper surface of the filled dielectric material is in contact with a lower surface of the cover, and a lower surface of the filled dielectric material is in contact with or not in contact with an upper surface of the top of the tuning rod.

In a second possible implementation manner of the fifth aspect, the upper surface of the dielectric material is welded or bonded to the lower surface of the cover.

In a third possible implementation manner of the fifth aspect, a shape of the face-to-face surfaces of the tuning rod and the dielectric material is a quadrilateral, a sector, a round rectangle, or a circle in which a defect part is provided.

In a fourth possible implementation manner of the fifth aspect, the dielectric material includes: ceramic, monocrystalline quartz, or spherical alumina.

In a fifth possible implementation manner of the fifth aspect, the resonator further includes a base plate connected to the bottom of the resonant cavity casing, and an elastic element pushing against the base plate and the tuning rod, where the elastic element is configured to provide elastic pressure for the tuning rod to press against the dielectric material.

In a sixth possible implementation manner of the fifth aspect, the resonance tube is integrated with the resonant cavity casing as one casing.

In a seventh possible implementation manner of the fifth aspect, a quality factor Qf of the dielectric material is greater than 5000.

According to a sixth aspect, a filter is provided, including at least one resonator provided in the foregoing fifth aspect.

According to a seventh aspect, a duplexer is provided, including a transmitter channel filter and a receiver channel filter, where the transmitter channel filter and the receiver channel filter perform filtering by using the filter in the foregoing sixth aspect.

According to an eighth aspect, a multiplexer is provided, including multiple transmitter channel filters and multiple receiver channel filters, where the transmitter channel filters and the receiver channel filters perform filtering by using the filter in the foregoing sixth aspect.

According to the resonator in the first aspect provided in various implementation manners, a dielectric material whose dielectric constant is greater than a dielectric constant of air is filled in a resonant cavity, which can reduce a volume of the resonator and improve a power capacity of the resonator, and because a volume of the dielectric material filled in the resonator is quite small, relative costs are quite low.

According to the resonator in the fifth aspect provided in various implementation manners, a dielectric material whose dielectric constant is greater than a dielectric constant of air is filled in a resonant cavity, a tuning rod is rotatable relative to the dielectric material, and a contact surface is in a non-circular structure, so that the tuning rod can conveniently adjust a frequency when being rotated relative to the dielectric material.

BRIEF DESCRIPTION OF THE DRAWINGS

To describe the technical solutions in the embodiments of the present invention or in the prior art more clearly, the following briefly introduces the accompanying diagrams required for describing the embodiments. Apparently, the accompanying diagrams in the following description show merely some embodiments of the present invention, and a person of ordinary skill in the art may still derive other diagrams from these accompanying diagrams without creative efforts.

DETAILED DESCRIPTION OF ILLUSTRATIVE EMBODIMENTS

The following clearly describes the technical solutions in the embodiments of the present invention with reference to the accompanying diagrams in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Figure 1:
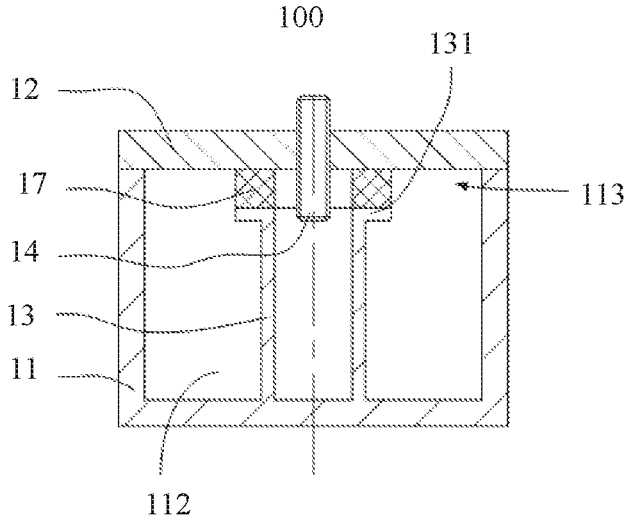
FIG. 1 is a cutaway diagram of a resonator according to a first implementation manner of the present invention.

Referring to FIG. 1, FIG. 1 is a cutaway diagram of a resonator 100 according to a first implementation manner of the present invention. The resonator 100 includes: a resonant cavity casing 11, a cover 12, a resonance tube 13, and a tuning screw 14.

The resonant cavity casing 11 is a metal cavity casing, the resonant cavity casing 11 may be a cavity casing that is entirely made of a metal material or that is metalized at least on an inner surface, and the resonant cavity casing 11 has a resonant cavity 112 and an open end 113. The cover 12 covers the open end 113 and is connected to the resonant cavity casing 11, and a connection manner of the cover 12 and the resonant cavity casing 11 may be connecting by using a screw, or the like. The cover 12 may be an independent component, or may be a PCB (printed circuit board). When the PCB is mounted on the resonant cavity casing 11 in a fastened manner and covers the open end 113, the PCB is used as the cover 12.

The resonance tube 13 is located inside the resonant cavity 112. In this implementation manner, the resonance tube 13 is integrated with the resonant cavity casing 11 as one casing, that is, the resonance tube 13 is integrated on an inner side surface of the bottom of the resonant cavity casing 11 as one casing. In another implementation manner, the resonance tube 13 may be an independently disposed component, and is connected to the resonant cavity casing 11 in a fastened manner by using a fastening element.

The tuning screw 14 is connected to the cover 12 and stretches into the resonance tube 13, and a length of a part that is of the tuning screw 14 and that stretches into the resonance tube 13 is changed by rotating the tuning screw 14, so that frequency may be adjusted. In this implementation manner, the tuning screw 14 and the resonance tube 13 are coaxially disposed.

The resonator 100 further includes a dielectric material 17 that is filled in the resonant cavity 112 and whose dielectric constant is greater than 1.

The dielectric material 17 is filled in a capacitance area formed between the top of the resonance tube 13 and the cover 12.

An upper end surface and a lower end surface of the dielectric material 17 respectively are in contact with a lower surface of the cover 12 and an upper surface of the resonance tube 13.

The capacitance area specifically includes at least one of an area between the resonance tube 13 and the cover 12, an area between the tuning screw 14 and an inner wall of the resonance tube 13, or an area between an outer edge of the resonance tube 13 and a cavity wall of the resonant cavity 112. These areas have greater electric intensity than another area inside the resonant cavity casing, that is, these areas have relatively high electric intensity.

Specifically, in an implementation manner, the dielectric material 17 may be tightly in contact with the cover 12 and the resonance tube 13, that is, an air gap between the dielectric material 17 and the lower surface of the cover 12 is less than 0.2 mm, and an air gap between the dielectric material 17 and the upper surface of the resonance tube 13 is less than 0.2 mm.

The dielectric material 17 includes but is not limited to: ceramic, monocrystalline quartz, or spherical alumina.

Referring to FIG. 1, optionally, the top of the resonance tube 13 of the resonator 100 may have a disc 131 that extends outwards, and the dielectric material 17 is filled between the cover 12 and the disc 131. By using this structure, a filling volume of the dielectric material 17 can be increased; or in the case of a same volume of the dielectric material 17, a decrease in a height of the dielectric material 17 helps reduce an entire volume of the resonator 100.

The filled dielectric material 17 is separately fastened to the cover 12 and the resonance tube 13 by means of bonding or welding.

Further, a quality factor Qf of the dielectric material 17 is greater than 5000, to reduce a dielectric loss. The quality factor is a reciprocal of the dielectric loss of the dielectric material 17. Because the low-loss dielectric material 17 may be filled, a loss of the dielectric material 17 can be lower in a case in which the resonator 100 in this implementation manner has a same resonant cavity volume as an SIR resonator (stepped-impedance resonator, Stepped Impedance Resonator), and an increase in the dielectric loss brought by the filled dielectric material can be less than a decrease in a conductor loss; therefore, a loss of the resonator 100 provided in this embodiment of the present invention is less than that in an SIR technology.

Beneficial effects generated by the resonator 100 in this implementation manner of the present invention are as follows:

(1) According to the resonator 100 in this implementation manner of the present invention, the dielectric constant of the filled dielectric material 17 of the resonator 100 is greater than a dielectric constant of air, a larger dielectric constant of the dielectric material 17 indicates higher equivalent series inductance, and inductance between the resonance tube 13 and the cover 12 is larger when being compared with that of a cavity without a dielectric material, so that the resonant cavity 112 can work in a lower frequency; or when a single cavity with a same resonance frequency is compared with a resonant cavity that is entirely filled with air, a volume of the resonator 100 in this implementation manner is smaller, and therefore, an effect of reducing the volume of the resonator can be achieved.

(2) According to the resonator 100 in this implementation manner of the present invention, an area with relatively high electric intensity inside the resonant cavity 112 is filled with the dielectric material 17, the dielectric constant of the filled dielectric material 17 is greater than 1, and breakdown electric intensity of the dielectric material 17 is generally several times to dozens of times higher than breakdown electric intensity of air; therefore, compared with a manner in which a resonant cavity is filled with air, this implementation manner of the present invention can improve a power capacity of the resonator.

(3) Only the area with relatively high electric intensity inside the resonant cavity 112 is partially filled with a small quantity of dielectric materials 17, and a volume of the filled dielectric materials 17 is quite small; therefore, compared with a TM (transverse magnetic) mode dielectric filter, the resonator 100 in this implementation manner of the present invention has quite low relative costs.

Figure 2:
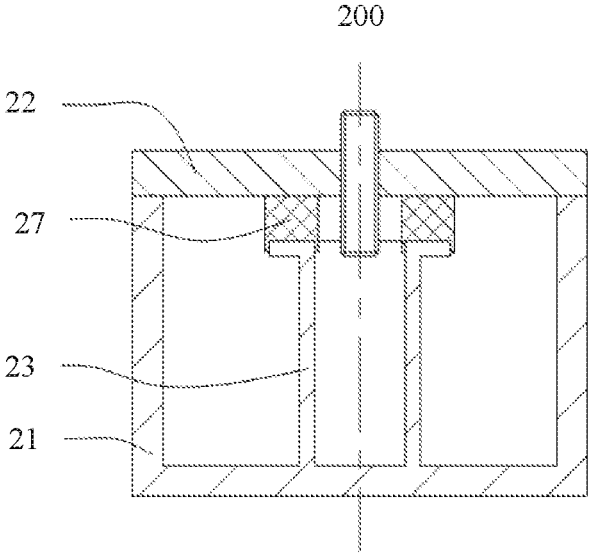
FIG. 2 is a cutaway diagram of a resonator according to a second implementation manner of the present invention.

Referring to FIG. 2, FIG. 2 is a cutaway diagram of a resonator 200 according to a second implementation manner of the present invention. The resonator 200 is basically similar to the resonator 100 shown in FIG. 1, and a difference between the resonator 200 and the resonator 100 lies in that the filled dielectric material 27 is crimped between the cover 22 and the resonance tube 23. An implementation manner of the resonator 200 may be as follows: A thickness of the dielectric material 27 is properly set; when the cover 22 is mounted on the resonant cavity casing 21 in a fastened manner, the cover 22 presses against the dielectric material 27; the dielectric material 27 is tightly crimped between the cover 22 and the resonance tube 23. By using this mounting manner, mounting of the dielectric material 27 can be facilitated.

Figure 3:
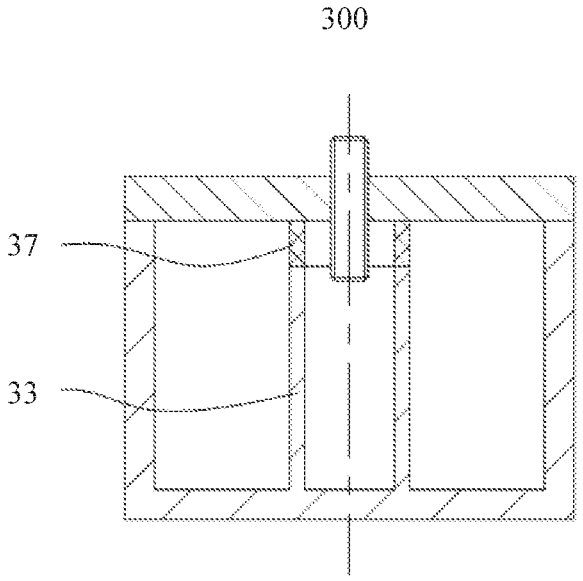
FIG. 3 is a cutaway diagram of a resonator according to a third implementation manner of the present invention.

Referring to FIG. 3, FIG. 3 is a cutaway diagram of a resonator 300 according to a third implementation manner of the present invention. The resonator 300 is basically similar to the resonator 100 shown in FIG. 1, and a difference between the resonator 300 and the resonator 100 lies in that the resonance tube 33 is a post, a disc is not formed on the top of the resonance tube 33, and an upper surface and a lower surface of the dielectric material 37 is respectively fastened to the cover 32 and the resonance tube 33 by means of bonding. By using this structure, shaping of the resonance tube 33 is facilitated.

Figure 4:
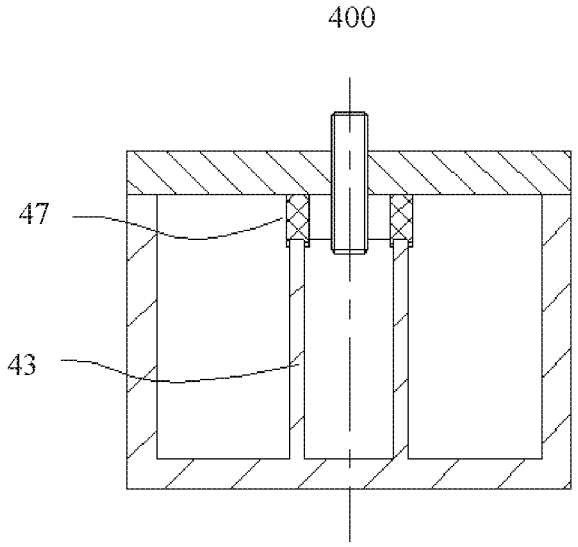
FIG. 4 is a cutaway diagram of a resonator according to a fourth implementation manner of the present invention.

Referring to FIG. 4, FIG. 4 is a cutaway diagram of a resonator 400 according to a fourth implementation manner of the present invention. The resonator 400 is basically similar to the resonator 200 shown in FIG. 2, and a difference between the resonator 400 and the resonator 200 lies in that the resonance tube 43 is a post, a disc is not formed on the top of the resonance tube 43, and the dielectric material 47 is crimped between the cover 42 and the resonance tube 43.

Figure 5:
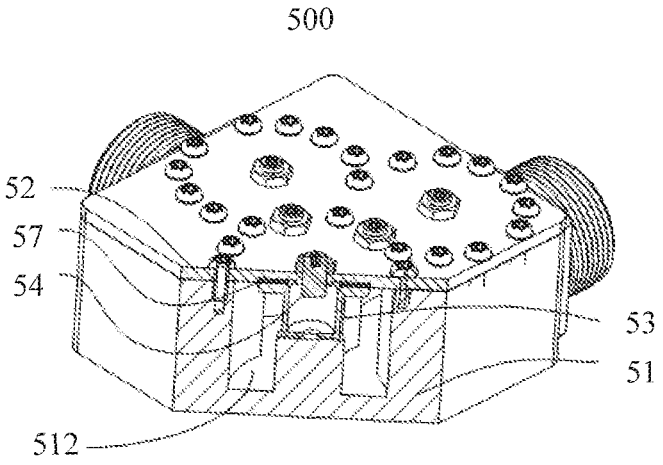
FIG. 5 is a three-dimensional cutaway diagram of an assembly state of a filter according to a fifth implementation manner of the present invention.
Figure 6:
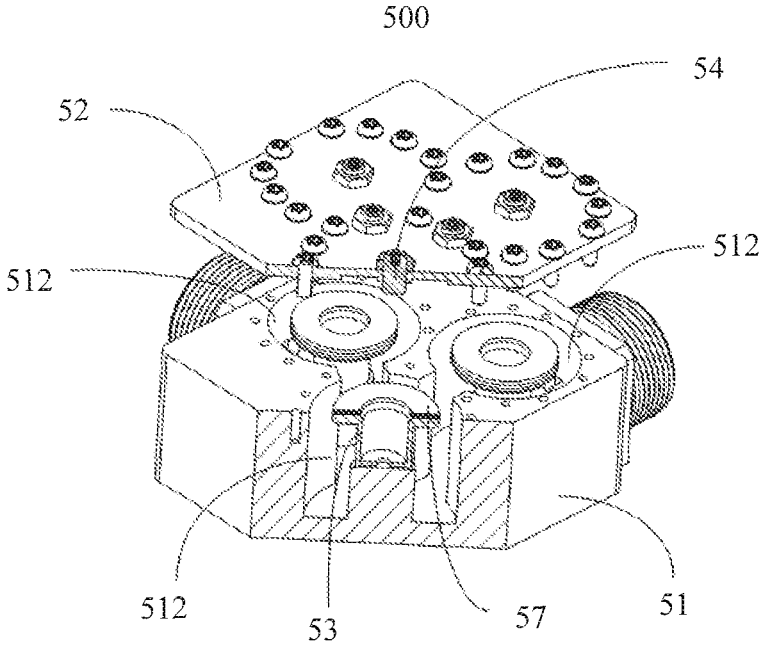
FIG. 6 is a three-dimensional exploded diagram of an assembly state of a filter according to a fifth implementation manner of the present invention.

Referring to FIG. 5 and FIG. 6, FIG. 5 and FIG. 6 respectively are a three-dimensional cutaway diagram and a three-dimensional exploded diagram of a filter 500 according to a fifth implementation manner of the present invention. The filter 500 is constructed by combining multiple foregoing resonators. As shown in FIG. 5 and FIG. 6, the filter 500 in this implementation manner includes three resonators that are arranged at an interval, and cover of the three resonators are integrated and resonant cavity casings that are of resonators located on the periphery of the filter are integrated; therefore, the filter 500 includes a case 51 and a cover 52 that covers the case 51. The case 51 is a metal case, the cover 52 is a metal cover, the case 51 may be a cavity casing that is entirely made of a metal material or that is metalized at least on an inner surface, and the metal cover 52 may be a plate casing that is entirely made of a metal material or that is metalized at least on a lower surface.

In this implementation manner, the filter 500 is a three-cavity filter. The case 51 has an open end and three resonant cavities 512. The cover 52 covers the open end. A resonance tube 53 and a tuning screw 54 corresponding to the resonant cavity 512 are disposed inside each resonant cavity 512. An area with relatively high electric intensity inside each resonant cavity 512 is filled with a dielectric material 57. A filling area and a filling manner for the dielectric material 57 are any one applied to the resonator in the first implementation manner to the fourth implementation manner.

Figure 7:
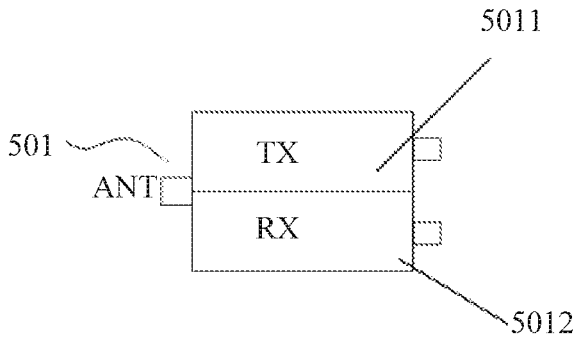
FIG. 7 is a schematic structural diagram of a duplexer according to a sixth implementation manner of the present invention.

Referring to FIG. 7, FIG. 7 is a schematic structural diagram of a duplexer 501 according to a sixth implementation manner of the present invention. The duplexer 501 includes a transmitter channel filter 5011 and a receiver channel filter 5012, where the transmitter channel filter 5011 and the receiver channel filter 5012 perform filtering by using the foregoing filter 500. The transmitter channel filter 5011 is configured to process a transmit signal of a transmitter, and the receiver channel filter 5012 is configured to process a receive signal of a receiver.

Figure 8:
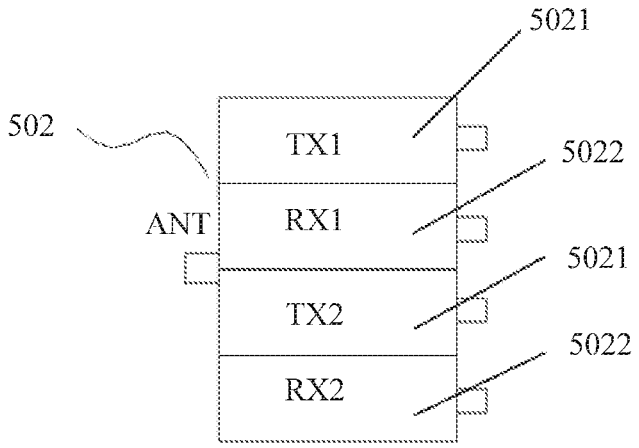
FIG. 8 is a schematic structural diagram of a multiplexer according to a seventh implementation manner of the present invention.

Referring to FIG. 8, FIG. 8 is a schematic structural diagram of a multiplexer 502 according to a seventh implementation manner of the present invention. The multiplexer 502 includes multiple transmitter channel filters 5021 and multiple receiver channel filters 5022, where the transmitter channel filters 5021 and the receiver channel filters 5022 perform filtering by using the foregoing filter 500. The figure shows two transmitter channel filters 5021 and two receiver channel filters 5022, and there may be three or more transmitter channel filters and receiver channel filters in another implementation manner. The transmitter channel filter 5021 is configured to process a transmit signal of a transmitter, and the receiver channel filter 5022 is configured to process a receive signal of a receiver.

Figure 9:
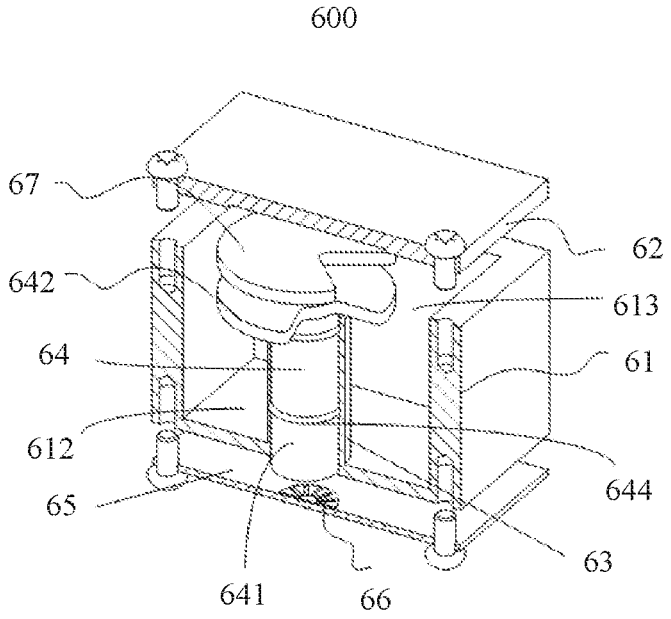
FIG. 9 is a three-dimensional cutaway diagram of a resonator according to an eighth implementation manner of the present invention.
Figure 10:
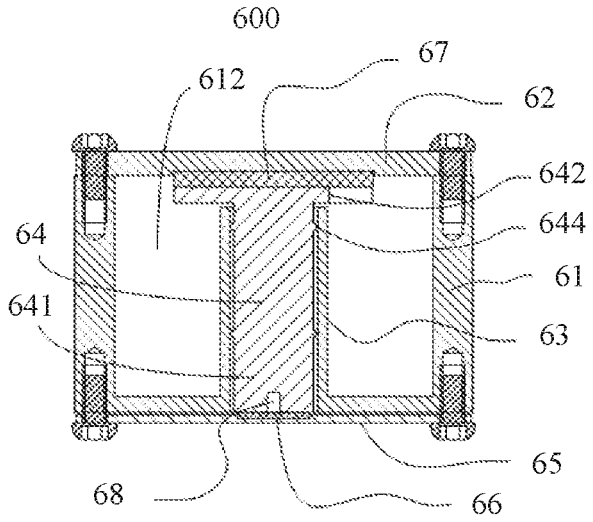
FIG. 10 is a full cutaway diagram of a resonator according to an eighth implementation manner of the present invention.

Referring to FIG. 9, FIG. 9 is a three-dimensional cutaway diagram of a resonator 600 according to an eighth implementation manner of the present invention. Referring to FIG. 10, FIG. 10 is a full cutaway diagram of the resonator 600 according to the eighth implementation manner of the present invention.

The resonator 600 includes: a resonant cavity casing 61, a cover 62, a resonance tube 63, and a tuning rod 64.

The resonant cavity casing 61 is a metal cavity casing, the resonant cavity casing 61 may be a cavity casing that is entirely made of a metal material or that is metalized at least on an inner surface, and the resonant cavity casing 61 has a resonant cavity 612 and an open end 613. The cover 62 covers the open end 613 and is connected to the resonant cavity casing 61, and a connection manner of the cover 62 and the resonant cavity casing 61 may be connecting by using a screw, or the like. The cover 62 may be an independent component, or may be a PCB. When the PCB is mounted on the resonant cavity casing 61 in a fastened manner and covers the open end 613, the PCB is used as the cover 62.

The resonance tube 63 is located inside the resonant cavity 612. In an implementation manner of the present invention, the resonance tube 63 is integrated with the resonant cavity casing 61 as one casing, that is, the resonance tube 63 is integrated on an inner surface of the bottom of the resonant cavity casing 61 as one casing. A circular via hole is disposed at the center of the resonance tube 63. In another implementation manner, the resonance tube 63 may be an independently disposed component, and is connected to the resonant cavity casing 61 in a fastened manner by using a fastening element. The fastening element plays a role of fastening the resonance tube 63, and the fastening element may be made of a metal piece or may be made of another material.

The resonator 60o further includes a dielectric material 67 that is filled in the resonant cavity 612 and whose dielectric constant is greater than 1. The dielectric material 67 is filled in a capacitance area formed between the top of the resonance tube 63 and the cover 62. The capacitance area may include: an area between a top surface of the resonance tube 63 and a lower surface of the cover 62, or an area between the top of a cavity casing encircled by an inner wall of the resonance tube 63 and a lower surface of the cover 62. The capacitance area has greater electric intensity than another area inside the resonant cavity casing 612, that is, this area has relatively high electric intensity.

In a scenario in which a resonance frequency needs to be adjusted, the tuning rod 64 is rotatable relative to the dielectric material 67, and a contact surface of the tuning rod 64 and the dielectric material 67 is in a non-circular structure, so that the tuning rod 64 can adjust the frequency when being rotated relative to the dielectric material 67. The non-circular structure refers to a circle with an incomplete cross section, such as a quadrilateral, a sector, or a circle with a gap.

In this implementation manner, an upper surface of the filled dielectric material 67 is in contact with the lower surface of the cover 62, and a lower surface of the filled dielectric material 67 is in contact with or not in contact with an upper surface of the top of the tuning rod.

Optionally, the upper surface of the dielectric material 67 is fastened to the lower surface of the cover 62 by means of welding or bonding.

In this implementation manner, optionally, the tuning rod 64 includes a main part 641 inserted inside the resonance tube 63, and a resonant disc 642 formed on the top of the main part 641. The resonant disc 642 is located between the main part 641 and the cover 62, and protrudes from the top of the resonance tube 63. A diameter of the resonant disc 642 is greater than an outer diameter of the resonance tube 63. The dielectric material 67 is filled between the resonant disc 642 and the cover 62. Disposing of the resonant disc 642 helps increase an area of contact between the resonant disc 642 and the dielectric material 67, to increase a volume of the dielectric material 67; or in the case of a same volume of the dielectric material 67, a decrease in a height of the dielectric material 67 helps reduce an entire volume of the resonator 600.

In an implementation manner of the present invention, the resonator 600 further includes a base plate 65 connected to the bottom of the resonant cavity casing, and an elastic element 66 pushing against the base plate 65 and the tuning rod 64. The elastic element 66 provides elastic pressure for the tuning rod 64 to press against the dielectric material 67. The elastic element 66 may be a spring. The elastic element 66 is disposed, and when a frequency needs to be re-adjusted, the base plate 65 may be released, and after the tuning rod 64 is separated from the dielectric material 67, adjustment is performed.

The base plate 65 is connected to a base plate of the resonant cavity casing 61, where a connection manner of the base plate 65 and the resonant cavity casing 61 may be connecting by using a screw, or may be another manner, which is not limited herein. The screw plays a role of connecting the base plate 65 and the resonant cavity casing 61, where a metal screw may be used, or a screw made of another material may be used.

In an implementation manner of the present invention, optionally, the resonator boo further includes a tuning screw 68, where the tuning screw 68 is configured to adjust rotation of the tuning rod 64. Specifically, the tuning screw 68 penetrates the base plate 65 and is connected to the tuning rod 64 in a fastened manner. When the tuning screw 68 is rotated by using a tool, for example, a screwdriver, the tuning rod 64 may be driven to rotate, to change a relative position between the tuning rod 64 and the dielectric material 67, that is, to adjust a position at which the tuning rod 64 and the dielectric material 67 mutually overlap, so as to adjust a frequency. Using of the tuning screw 68 may help perform fine adjustment and multiple times of adjustment.

In an implementation manner, the tuning screw 68 may not be disposed to perform frequency adjustment; instead, after the relative position between the tuning rod 64 and the dielectric material 67 is adjusted to achieve a required frequency, a position of the tuning rod is fastened by means of dispensing.

A grounding protrusion part 644 that remains to be connected to an inner side wall of the resonance tube 63 is disposed on a side surface of the tuning rod 64. In a rotation process of the tuning rod 64, the tuning rod 64 remains to be connected to the inner wall of the resonance tube 63 by using the grounding protrusion part 644. In this implementation manner, the grounding protrusion part 644 is a torus encircling the main part 641. In another implementation manner, the resonance tube 63 may be grounded in another manner. For example, grounding is implemented by using a ground point at the bottom.

Figure 11:
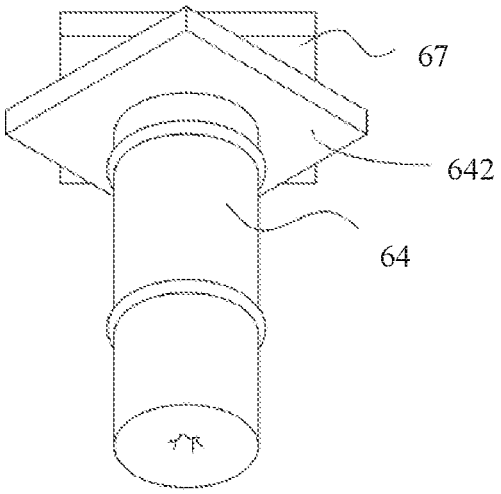
FIG. 11 is a structural diagram of a tuning rod and a dielectric material that are of a resonator according to a ninth implementation manner of the present invention.

Referring to FIG. 11, in an implementation manner of the present invention, a shape of the contact surface of the tuning rod 64 and the dielectric material 67 is a quadrilateral, that is, both the resonant disc 642 and the dielectric material 67 are quadrilaterals.

Figure 12:
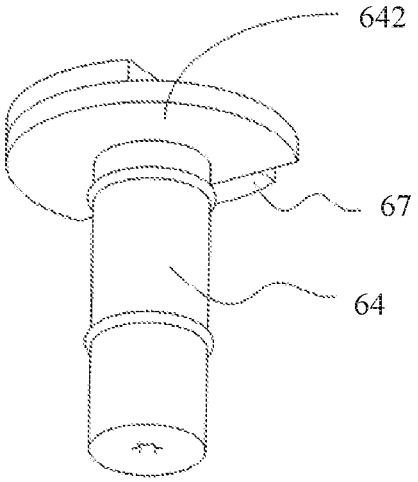
FIG. 12 is a structural diagram of a tuning rod and a dielectric material that are of a resonator according to a tenth implementation manner of the present invention.

Referring to FIG. 12, in another implementation manner of the present invention, a shape of the contact surface of the tuning rod 64 and the dielectric material 67 is a sector, that is, both the resonant disc 642 and the dielectric material 67 are sectors.

Figure 13:
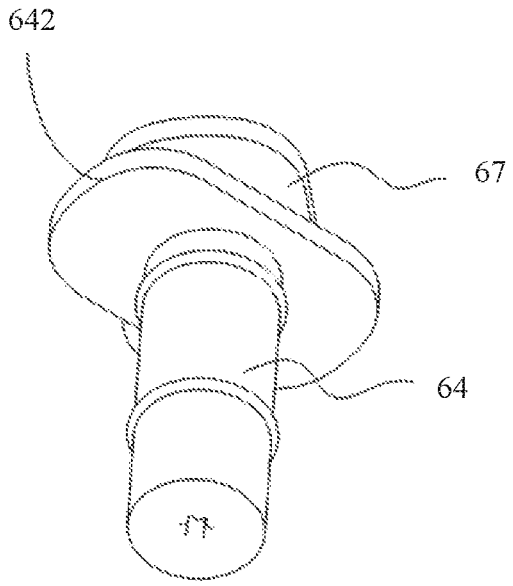
FIG. 13 is a structural diagram of a tuning rod and a dielectric material that are of a resonator according to an eleventh implementation manner of the present invention.

Referring to FIG. 13, in still another implementation manner, a shape of the contact surface of the tuning rod 64 and the dielectric material 67 is a round rectangle, that is, both the resonant disc 642 and the dielectric material 67 are round rectangles.

Certainly, in another implementation manner, a shape of the contact surface of the tuning rod 64 and the dielectric material 67 may be a circle in which a defect part is provided, for example, a circle in which a regular or an irregular gap is provided, or a circle in which a via hole is provided on a surface. The foregoing shape of the contact surface of the tuning rod 64 and the dielectric material 67 may be selected according to convenience of a manufacturing technique.

The resonator 600 in this implementation manner of the present invention has the following beneficial technical effects:

(1) According to the resonator 600 in this implementation manner of the present invention, the dielectric constant of the filled dielectric material 67 of the resonator 600 is greater than a dielectric constant of air, a larger dielectric constant of the dielectric material 67 indicates higher equivalent series inductance, and inductance between the resonance tube 63 and the cover 62 is larger when being compared with that of a cavity, so that the resonant cavity 612 can work in a lower frequency; or when a single cavity with a same resonance frequency is compared with a resonant cavity that is entirely filled with air, a volume of the resonator 600 in this implementation manner of the present invention is smaller, and therefore, in the present invention, an effect of reducing the volume of the resonator can be achieved.

(2) The dielectric constant of the dielectric material 67 filled in the resonator 600 is greater than 1, and breakdown electric intensity of the dielectric material 67 is generally several times to dozens of times higher than breakdown electric intensity of air; therefore, in the present invention, a power capacity of the resonator 600 can be improved, and in addition, because the filled dielectric material 67 in the present invention is a low-loss dielectric, loss impact on the resonator 600 is quite slight.

(3) According to a traditional structure in which tuning is performed by adjusting a length of a part that is of the tuning screw and that stretches into the resonance tube 63, both large power and a low loss cannot be achieved at the same time; however, according to the resonator 600 of the present invention, a problem of spacing between the tuning screw 68 and another component does not need to be considered, and therefore, the tuning rod of large power still can be designed according to a lowest loss.

(4) According to the resonator 600, the tuning rod 64 is rotated relative to the dielectric material 67 to change a relative position between the tuning rod 64 and the dielectric material 67, and therefore, a tuning range can be controlled, and an operation is convenient.

(5) It may be deduced from a basic principle of an electromagnetic field—tangential components of an electric field E are continuous, that a power capacity is hardly affected in a tuning process according to this solution, and too many power capacity margins do not need to be reserved in design, which facilitates mass production.

(6) According to the resonator 600, only the area with relatively high electric intensity inside the resonant cavity casing 612 is partially filled with the dielectric material 67, and a volume of the filled dielectric material 67 is quite small; therefore, relative costs are quite low.

(7) The resonator 600 further has advantages of a simple structure, convenient assembly, strong realizability, and facilitating mass production.

An implementation manner of the present invention further provides a filter (not shown in the diagrams), including the foregoing resonator 600.

An implementation manner of the present invention further provides a duplexer (not shown in the diagrams), including a transmitter channel filter and a receiver channel filter, where the transmitter channel filter and the receiver channel filter perform filtering by using the foregoing filter 600. The transmitter channel filter is configured to process a transmit signal of a transmitter, and the receiver channel filter is configured to process a receive signal of a receiver.

An implementation manner of the present invention further provides a multiplexer (not shown in the diagrams), including multiple transmitter channel filters and multiple receiver channel filters, where the transmitter channel filters and the receiver channel filters perform filtering by using the foregoing filter 600.

It may be understood that the filter, the duplexer, and the multiplexer provided in the foregoing embodiments may be applied to a communications system, or may be applied to a radar system, which may not be limited herein.

Finally, it should be noted that the foregoing embodiments are merely intended for describing the technical solutions of the present invention, but not for limiting the present invention. Although the present invention is described in detail with reference to the foregoing embodiments, a person of ordinary skill in the art should understand that the descriptions are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A resonator comprising:

a resonant cavity casing having a resonant cavity and an open end;

a cover covering the open end and being connected to the resonant cavity casing;

a resonance tube located inside the resonant cavity;

a tuning rod disposed inside the resonance tube; and a dielectric material located in the resonant cavity, wherein the dielectric material is located in a capacitance area formed between a top of the resonance tube and the cover, wherein dielectric material comprises a dielectric constant greater than 1, wherein the tuning rod is rotatable relative to the dielectric material, and wherein surfaces of the tuning rod and the dielectric material face each other and comprise non-circular structures so that an overlapping of the surfaces is changeable to adjust a frequency when the tuning rod is rotated relative to the dielectric material.

2. The resonator according to claim 1, wherein an upper surface of the dielectric material is in contact with a lower surface of the cover, and wherein a lower surface of the dielectric material is in contact with an upper surface of the top of the tuning rod.

3. The resonator according to claim 2, wherein the upper surface of the dielectric material is welded or bonded to the lower surface of the cover.

4. The resonator according to claim 1, wherein a shape of the surfaces of the tuning rod and the dielectric material facing each other is a quadrilateral, a sector, a round rectangle, or a circle in which a defect part is provided.

5. The resonator according to claim 1, wherein the dielectric material comprises ceramic, monocrystalline quartz, or spherical alumina.

6. The resonator according to claim 1, further comprising:

a base plate connected to a bottom of the resonant cavity casing; and an elastic element pushing against the base plate and the tuning rod, wherein the elastic element is configured to provide elastic pressure so that the tuning rod presses against the dielectric material.

7. The resonator according to claim 1, wherein the resonance tube is integrated with the resonant cavity casing.

8. The resonator according to claim 1, wherein a quality factor Qf of the dielectric material is greater than 5000.

9. A filter comprising:

at least one resonator, the at least one resonator comprising:

a resonant cavity casing including a resonant cavity and an open end;

a cover covering the open end and being connected to the resonant cavity casing;

a resonance tube located inside the resonant cavity;

a tuning rod disposed inside the resonance tube; and a dielectric material located in the resonant cavity, wherein the dielectric material is located in a capacitance area formed between a top of the resonance tube and the cover, wherein the dielectric material comprises a dielectric constant greater than 1, wherein the tuning rod is rotatable relative to the dielectric material, and wherein surfaces of the tuning rod and the dielectric material face each other and comprise non-circular structures so that an overlapping of the surfaces is changeable to adjust a frequency when the tuning rod is rotated relative to the dielectric material.

10. The filter according to claim 9, wherein an upper surface of the dielectric material is in contact with a lower surface of the cover, and wherein a lower surface of the dielectric material is in contact with an upper surface of the top of the tuning rod.

11. The filter according to claim 10, wherein the upper surface of the dielectric material is welded or bonded to the lower surface of the cover.

12. The filter according to claim 9, wherein a shape of the surfaces facing each other is a quadrilateral, a sector, a round rectangle, or a circle in which a defect part is provided.

13. The filter according to claim 9, wherein the dielectric material comprises ceramic, monocrystalline quartz, or spherical alumina.

14. The filter according to claim 9, further comprising:

a base plate connected to a bottom of the resonant cavity casing; and an elastic element pushing against the base plate and the tuning rod, wherein the elastic element is configured to provide an elastic pressure so that the tuning rod presses against the dielectric material.

15. A duplexer comprising:

a transmitter channel filter; and a receiver channel filter, wherein the transmitter channel filter and the receiver channel filter perform filtering by using a filter including at least one resonator, the at least one resonator comprising:

a resonant cavity casing comprising a resonant cavity and an open end;

a cover covering the open end and being connected to the resonant cavity casing;

a resonance tube located inside the resonant cavity;

a tuning rod disposed inside the resonance tube; and a dielectric material located in the resonant cavity, wherein the dielectric material is located in a capacitance area formed between a top of the resonance tube and the cover, wherein the dielectric material comprises a dielectric constant greater than 1, wherein the tuning rod is rotatable relative to the dielectric material, and wherein surfaces of the tuning rod and the dielectric material face each other and comprise non-circular structures so that an overlapping of the surfaces is changeable to adjust a frequency when the tuning rod is rotated relative to the dielectric material.

16. The duplexer according to claim 15, wherein an upper surface of the dielectric material is in contact with a lower surface of the cover, and wherein a lower surface of the dielectric material is in contact with an upper surface of the top of the tuning rod.

17. The duplexer according to claim 16, wherein the upper surface of the dielectric material is welded or bonded to the lower surface of the cover.

18. The duplexer according to claim 15, wherein a shape of the surfaces facing each other is a quadrilateral, a sector, a round rectangle, or a circle in which a defect part is provided.

19. The duplexer according to claim 15, wherein the dielectric material comprises ceramic, monocrystalline quartz, or spherical alumina.

20. The duplexer according to claim 15, wherein the resonator further comprises a base plate connected to a bottom of the resonant cavity casing, and an elastic element configured to push against the base plate and the tuning rod, and wherein the elastic element is configured to provide elastic pressure for the tuning rod to press against the dielectric material.

* * * * *